US006808066B2

(12) United States Patent
Bean

(10) Patent No.: US 6,808,066 B2
(45) Date of Patent: Oct. 26, 2004

(54) POUCH FOR HEATED APPLIANCES

(76) Inventor: Bruce L. Bean, 872 S. 400 West, Burley, ID (US) 83318

( * ) Notice: Subject to any disclaimer, the term of this patent is extended or adjusted under 35 U.S.C. 154(b) by 166 days.

(21) Appl. No.: 10/260,267

(22) Filed: Oct. 1, 2002

(65) Prior Publication Data

US 2003/0062278 A1 Apr. 3, 2003

Related U.S. Application Data

(60) Provisional application No. 60/326,209, filed on Oct. 2, 2001.

(51) Int. Cl.[7] ..... A45C 11/26

(52) U.S. Cl. ..... 206/349; 150/165; 493/243; 493/922

(58) Field of Search ..... 493/210, 214, 493/226, 243, 916, 922; 206/349, 363, 581, 576, 484; 150/154, 161, 165

(56) References Cited

U.S. PATENT DOCUMENTS

| | | | | |
|---|---|---|---|---|
| D261,317 | S | | 10/1981 | Oberheim et al. |
| D270,671 | S | | 9/1983 | Yamamoto |
| D281,024 | S | | 10/1985 | Rittenhouse et al. |
| 4,570,792 | A | | 2/1986 | Conway |
| 4,660,610 | A | | 4/1987 | McIntire, III |
| 4,759,742 | A | * | 7/1988 | Achelpohl ..... 493/195 |
| 5,062,529 | A | | 11/1991 | Blair |
| 5,203,456 | A | | 4/1993 | Boswell |
| D348,542 | S | | 7/1994 | Cannella |
| 5,562,209 | A | | 10/1996 | Jackson et al. |
| 5,577,607 | A | | 11/1996 | Drake et al. |
| 5,638,955 | A | | 6/1997 | Calciano |
| 5,718,104 | A | * | 2/1998 | Kennedy ..... 53/491 |
| 5,878,757 | A | | 3/1999 | Hernandez |
| 5,950,826 | A | | 9/1999 | Lykowski |
| 6,000,542 | A | | 12/1999 | Smith |
| 6,068,122 | A | | 5/2000 | Burns et al. |
| 6,070,729 | A | | 6/2000 | Barnes |
| 6,109,446 | A | | 8/2000 | Foote |
| 6,209,723 | B1 | | 4/2001 | Fields |

FOREIGN PATENT DOCUMENTS

| | | |
|---|---|---|
| EP | 313689 | 5/1989 |
| GB | 2178407 | 2/1987 |
| GB | 2226009 | 6/1990 |
| JP | 06-135486 | 5/1994 |

* cited by examiner

*Primary Examiner*—Jacob K. Ackun, Jr.
(74) *Attorney, Agent, or Firm*—Richard C. Litman

(57) ABSTRACT

A pouch for heated appliances protects external articles from damage from heat emitted from the appliance immediately after use. The present pouch is formed of inner and outer fabric sheets, with the inner sheet comprising a heat resistant synthetic material and the outer sheet comprising a durable material for wear resistance. A series of manufacturing steps results in all seams being disposed within the insulating volume between the two plies of material, with the two sheets being joined only along the open top or upper edge of the pouch in order to minimize heat transfer along any common seams. The permanently open top is secured by an adjustably positionable strap which secures between the handle and clip lever of the curling iron, with the open top providing ventilation for the heated appliance. External ties are provided for securing the appliance cord externally to the appliance, to avoid heat damage thereto.

18 Claims, 6 Drawing Sheets

POUCH FOR HEATED APPLIANCES

CROSS-REFERENCE TO RELATED APPLICATION

This application claims the benefit of U.S. Provisional Patent Application Serial No. 60/326,209, filed Oct. 2, 2001.

BACKGROUND OF THE INVENTION

1. Field of the Invention

The present invention relates generally to protective containers, and more specifically to a pouch formed of a flexible fabric material for safely containing a heated appliance. The present protective pouch is particularly adapted for containing an electrically heated hair curling iron therein, but may be adapted for containing other appliances having similar configurations.

2. Description of Related Art

Heated appliances are used for various tasks and applications, with electrically heated devices, e.g. curling irons, hair dryers, etc. used almost universally for cosmetic purposes. A perennial problem with such appliances, is the storage of the appliance immediately after use, when it is still hot. This is not such a major problem in the household, where space is generally available for storing the appliance after use, but such storage immediately after use becomes a problem during travel, when the appliance and other belongings must be packed immediately after use for travel.

Accordingly, a need will be seen for a pouch for containing a heated appliance, which pouch serves to insulate and protect any immediately adjacent articles from the heat emitted from the still hot appliance. The present pouch comprises a structure formed of an inner layer of flexible fabric material having heat resistant properties, with an outer layer of fabric surrounding the inner layer, to form a two ply pocket for the device. Additional features, such as an adjustably positionable top closure, laterally disposed securing straps or ties for the electrical cord, and a hanging strap, may also be provided.

A discussion of the related art of which the present inventor is aware, and its differences and distinctions from the present invention, is provided below.

U.S. Pat. No. 4,570,792 issued on Feb. 18, 1986 to Kay S. Conway, titled "Case For Curling Iron Or Similar Article," describes a pouch formed of a flexible laminate comprising an inner liner and an outer covering. The Conway case differs from the present invention in that (1) Conway stitches the two plies of material together along the bottom and one edge, which results in greater heat transfer between plies, (2) Conway closes his case with a flap which limits the extension of an article therefrom and which limits ventilation of the heated interior of the case, and (3) Conway fails to provide a hanging strap for his case.

U.S. Pat. No. 4,660,610 issued on Apr. 28, 1987 to Dana L. McIntire III, titled "Insulating Device For Heated Working Tools Such As Welding Torches And The Like," describes a pocket or pouch in which a welding or cutting torch may be placed temporarily during a welding or cutting operation. The McIntire, III device is open at both ends and slips over the end of the torch to protect other materials from contact with the heated tip of the torch. No closure is provided, as the device is intended only for temporary use, and is not intended to store the torch for any extended period of time. No hanging strap or cord or accessory ties are provided by McIntire, III with his torch protection device.

U.S. Pat. No. 5,062,529 issued on Nov. 5, 1991 to Connie D. Blair, titled "Enclosure For Curling Iron Or Similar Article," describes a hard rectangular case with a separate lid. A partition is provided for separating the curling iron and its electrical cord, with both the iron and cord being placed in the box together. No flexible wall pouch, double ply construction, adjustable closure, or external ties are disclosed by Blair.

U.S. Pat. No. 5,203,456 issued on Apr. 20, 1993 to Rudy Boswell, titled "Curling Iron Travel Case," describes another hard shell case for carrying two curling irons therein. The cords are carried within the Boswell case, rather than externally, as in the present pouch. The Boswell case more closely resembles the case of the Blair U.S. Pat. No. '529, than it does the present pouch invention.

U.S. Pat. No. 5,562,209 issued on Oct. 8, 1996 to Patricia N. Jackson et al., titled "Heat Resistant Curling Iron Cooler," describes a device formed of foam rubber with an insulating liner. The foam rubber outer shell holds its shape, unlike the fabric material of the present pouch. Jackson et al. provide an elastic cord to hook over the clamp lever to secure a curling iron in the holder, but do not provide a structure having two plies of fabric material nor any means for securing the electrical cord externally.

U.S. Pat. No. 5,577,607 issued on Nov. 26, 1996 to Anthony G. Drake et al., titled "Curling Iron Pouch," describes a pouch formed of a series of heat resistant fabric sheets. However, due to the construction used by Drake et al., their pouch differs considerably from the present heated appliance pouch. Drake et al. cut four separate pieces of material comprising two pouch sides and two external pocket sides, and stitch them together completely around their common edges. In contrast, the present pouch conserves labor by cutting a single blank each for the inner and outer pockets. The blanks are sewn together along what will become their common open upper edge, then everted and sewn to form a pocket and sleeve. The outer sleeve is then folded over the inner pocket, and stitched along its bottom edge to close the assembly. Moreover, Drake et al. provide only a fixed closure (i.e., snap) for their pouch, whereas the closure of the present pouch may be adjusted to fit different appliances. Also, Drake et al. do not provide a separate external tie for securing the appliance cord.

U.S. Pat. No. 5,638,955 issued on Jun. 17, 1997 to C. Daniel Calciano, titled "Transportable Holder For An Electrically Powered Styling Instrument," describes a pouch having only a single pocket, with a bifurcated closure flap at the open end thereof. The entire hair curler fits within the Calciano holder, with only the cord extending from the slot of the flap to the outside of the holder. While Calciano provides external cord holding means, the means comprises only a pair of hooks, rather than the positive cord retaining straps of the present pouch. Moreover, no hanging strap is provided for the Calciano holder.

U.S. Pat. No. 5,878,757 issued on Mar. 9, 1999 to Adelaida Hernandez, titled "Carrying Case For Hair Styling Equipment," describes a generally rectangular, hard sided briefcase type container. One side has a recess formed therein, with a flexible fabric closure panel overlying the recess. A hair curler or the like may be stored within this recess. The hard materials of which the Hernandez case is constructed, along with its complexity, result in a device more closely related to the travel case of the Boswell U.S. Pat. No. '456, than to the present appliance pouch.

U.S. Pat. No. 5,950,826 issued on Sep. 14, 1999 to Barbara J. Lykowski, titled "Curling Iron Travel Case," describes a device formed of multiple layers of heat resistant fabric and including a series of internal pockets. The Lykowski case is sufficiently large and bulky to require a pair of carrying handles, but no hanging loop is disclosed. Lykowski stores the appliance cord within the outer sheet, rather than using a separate tie.

U.S. Pat. No. 6,000,542 issued on Dec. 14, 1999 to Joseph C. Smith, titled "Seaming Iron Holder," describes a device having opposite open sides when the two ends are brought together for carrying a seaming iron therein. While Smith states that his holder is formed of flexible materials, the drawings suggest that the device is actually formed of three rigid panels, with flexible joints between the two end panels and center panel. In any event, hanging strap, closure strap, or external cord tie are disclosed by Smith.

U.S. Pat. No. 6,068,122 issued on May 30, 2000 to Charles R. Burns et al., titled "Travel Pouch For Heated Appliances," describes a device which might be considered a simplified variation on the travel case of the Lykowski U.S. Pat. No. '826 discussed further above. The device folds across its center, and includes a single internal pocket on one side for two curling irons and a band for storage of the electrical cords on the inner surface of the other side. The two sides are closed by Velcro®. No external cord storage ties or hanging loop are provided by Burns et al. for their travel pouch.

U.S. Pat. No. 6,070,729 issued on Jun. 6, 2000 to Sallie L. Barnes, titled "Hairstyling Accessory Organizing System," describes several different embodiments of various containers formed of flexible fabric materials. The most closely related comprises an open top bag with a single external pocket on one side thereof. The device is more closely related to the configuration of a conventional shopping bag, than to the present pouch invention.

U.S. Pat. No. 6,109,446 issued on Aug. 29, 2000 to Antoinette Foote, titled "Collapsible Curling Iron Holder," describes a hard shelled case having an outwardly hinged panel with a series of cylindrical receptacles therein for holding a number of curling irons. The irons may be stored in the lower portion of the closed case when not in use. The Foote curling iron holder thus more closely resembles the hard shell case of the Hernandez U.S. Pat. No. '757 discussed further above, than the present pouch.

U.S. Pat. No. 6,209,723 issued on Apr. 3, 2001 to Darren Fields, titled "Tool Wraps," describes various embodiments of a fabric panel having various securing means for wrapping and enclosing various types of tools therein. Other, case-like embodiments are also disclosed. Of all of the embodiments disclosed in the Fields patent, the flat wrap embodiments most closely resemble the present pouch. However, they actually more closely resemble the devices of the Lykowski '826, Burns et al. '122, and Barnes U.S. Pat. No. '729 discussed above, than the present pouch for heated appliances invention.

U.S. Pat. No. D-261,317 issued on Oct. 13, 1981 to Robert Oberheim et al., titled "Combined Curling Iron With Cover," illustrates a design which appears to be a hard shelled case having a generally cylindrical configuration. No closure ties or external cord retaining ties are apparent in the Oberheim et al. design.

U.S. Pat. No. D-270,671 issued on Sep. 20, 1983 to Shinji Yamamoto, titled "Case For A Hair Roller Set," illustrates a design having a generally rectangular configuration with a series of compartments therein. The Yamamoto design more closely resembles the cases of the Hernandez U.S. Pat. Nos. '757 and Foote '446, than it does the present pouch for heated appliances.

U.S. Pat. No. D-281,024 issued on Oct. 15, 1985 to James M. Rittenhouse et al., titled "Carrying Case For A Hair Curler," illustrates another generally rectangular case apparently having a hard shell. The Rittenhouse et al. design more closely resembles the cases of the Hernandez U.S. Pat. Nos. '757 and Foote '446, and particularly the Yamamoto U.S. Design Patent No. '671, than it does the present pouch for heated appliances invention.

U.S. Pat. No. D-348,542 issued on Jul. 5, 1994 to John C. Cannella, titled "Curling Iron Holder," illustrates a design apparently comprising a pair of opposed pouches in a single sheet of fabric material. The larger pouch at one end is apparently used to store the curling iron, while the smaller pouch at the opposite end is used for electrical cord storage. The two pouches are apparently folded together for closure of the Cannella holder. Cannella does not provide a permanently open end having an adjustably positionable closure strap thereacross or means of securing the electrical cord externally on the pouch, which features are parts of the present pouch for heated appliances invention.

British Patent Publication No. 2,178,407 published on Feb. 11, 1987 to The Silvaflame Company Limited, titled "Container For Accessories," describes a generally rectangular, hard shelled (sheet metal) case for holding machine tool accessories (clamps, etc.). The Silvaflame case thus more closely resembles the hard shell cases of the Hernandez U.S. Utility Patent Nos. '757 and Foote '446 and the Yamamoto U.S. Design Patent Nos. '671 and Rittenhouse et al. '024, than it does the present pouch for heated appliances invention.

European Patent Publication No. 313,689 published on May 3, 1989 to A. L. Mother's Helpers Industries Inc., titled "Disposable Kit For Toiletry Or Like Products," describes an article formed of thin sheet plastic, having a relatively large pouch at one end and a shallower pocket at the opposite end. Additional article storage is provided by a series of smaller pockets outside the large main pocket. The kit is folded closed after use with the pocket and pouch to the inside, with the outer surface doubled over. The resulting configuration more closely resembles the curling iron holder of the Cannella U.S. Design Patent No. '542, than it does the present pouch for heated appliances invention.

British Patent Publication No. 2,226,009 issued on Jun. 20, 1990 to Rodney B. Storach, titled "Tool Box," describes a box having a hard plastic shell with a swing out upper front portion. The Storach box more closely resembles the various other hard shelled cases of various patent publications discussed further above, than it does the present pouch for heated appliances.

Finally, Japanese Patent Publication No. 06-135,486 published on May 17, 1994 to Seiichi Nakada et al., titled "Device For Packing Iron," describes (according to the drawings and English abstract) a shipping container apparently formed of cardboard or the like, in which a clothing iron and a stand for the iron are packed for shipping. The economically disposable materials used for such shipping boxes are not suitable for the heat resistance required for containers adapted for holding heating appliances immediately after use, as in the present invention. In any event, the rigid structure of the box of the Japanese Patent Publication more closely resembles the other hard shell cases of the various patent publications discussed further above, than it does the present pouch for heated appliances.

None of the above inventions and patents, taken either singly or in combination, is seen to describe the instant invention as claimed.

SUMMARY OF THE INVENTION

The present invention is a pouch for heated appliances, for protecting articles external to the pouch from damage from the heat of the recently used appliance. The present pouch is particularly suitable for use in containing a curling iron and its electrical cord for travel, as when the iron must be packed away immediately after use when checking out of a motel or hotel room during travel. However, the present pouch for heated appliances may be adapted or used for containing other types of heating appliances as well.

The present pouch is formed of an inner sheet of heat resistant material, and an outer sheet of material enclosing the inner sheet. The pouch is essentially formed by cutting a single sheet of material each for the inner sheet and outer sheets. The two sheets are sewn together along a common edge, which will become the opening for the completed pouch. Both sheets are then folded laterally and stitched along their respective outer lateral edges, with the outer sheet also being sewn closed along its bottom edge. Any ties, closure tabs, and/or hanging loop are also stitched in place during this operation.

At this point, the assembly is everted to place all stitching to the inside, with the intended exterior surface of the outer layer facing outwardly. The bottom end of the inner pocket is sewn closed, and the inner pocket is tucked into the outer pocket to form the completed double pocketed pouch. The common upper edge remains permanently open to the inner pocket, with a strap of hook and loop fabric material extending across the opening to secure removably to a mating spot of hook and loop material on the opposite side of the opening. The strap is adapted for passing between the handle and the clip or clamp lever of a curling iron, thereby securing the iron within the pouch and allowing heat to escape from the open end of the pouch. The present pouch may include additional features as well, such as a hanging strap and an external tie or ties for securing the electrical cord of the appliance externally from the heating appliance within the pouch, thereby precluding heat damage to the cord.

Accordingly, it is a principal object of the invention to provide a pouch for holding a heated appliance therein, for protecting adjacent articles from heat emitted by the heated appliance placed within the pouch.

It is another object of the invention to provide such a pouch comprising an inner pocket of heat resistant fabric material, and an external secondary sheet of material forming a double pocket structure, with the two pockets being connected only along their common open upper edges or top.

It is a further object of the invention to provide a pouch formed of only two basic sheets of material, with the two sheets being folded along their common centerline before stitching, with the folded edge defining one side of the pouch.

Still another object of the invention is to provide such a pouch having a permanently open top with an appliance retaining band removably extending thereacross, and further including a hanging loop and external power cord securing ties.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention comprises a pouch for containing a heated appliance, such as a hair curling iron, hair dryer, or other relatively small appliance having a heating element therewith. The heating elements of such appliances can get sufficiently hot as to cause damage to various materials which may come in contact with the heating element, particularly many or most natural and synthetic fabrics, plastics, etc. A user of such a heated appliance will not normally find this to be a problem in the household when exercising normal care. However, when using such an appliance during travel, a user may find it impossible to spend the time to allow such an appliance to cool before packing it away in a confined area such as a suitcase, overnight bag, etc. Under such circumstances, the heating element of the appliance is likely to do some damage to adjacent closely packed materials, particularly where no air circulation is provided.

The present pouch provides a solution for this problem, by providing a thermally insulated pouch in which a heated appliance may be placed immediately after use, without danger to other articles which may come in contact with the pouch. The pouch itself cannot be harmed by the heat produced by conventional heated appliances, as the materials of which the pouch is formed, are capable of resisting temperatures considerably higher than those produced by conventional heated appliances. The present pouch thus provides safety and convenience for the traveler, as well as being useful around the house and other environments as well.

Figure 1:
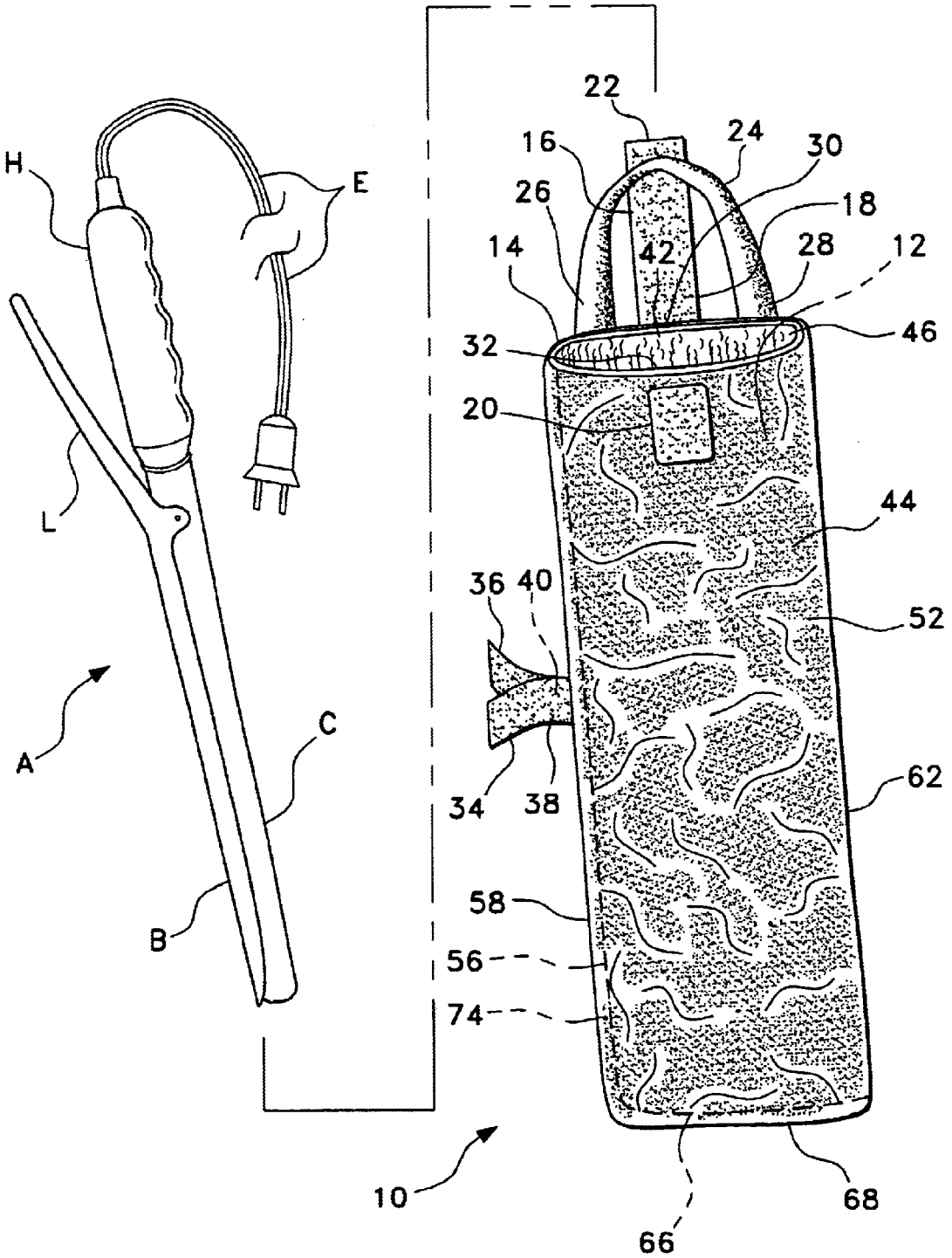
FIG. 1 is a perspective view of a pouch for heated appliances according to the present invention, showing the removable installation of a curling iron therein.
Figure 2:
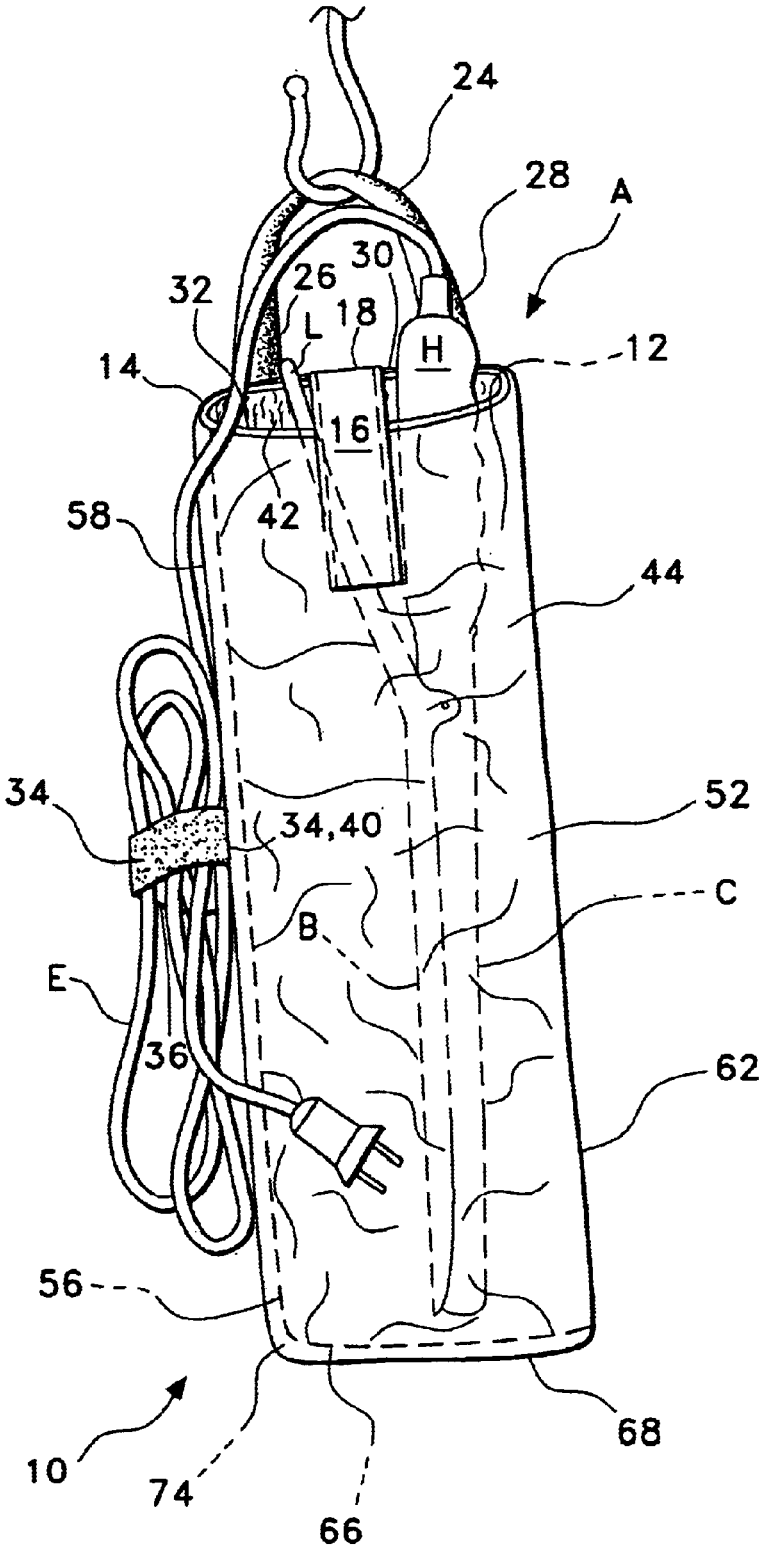
FIG. 2 is a perspective view similar to that of FIG. 1, but showing the curling iron secured within the pouch and the curling iron cord secured to the exterior of the pouch.

FIGS. 1 and 2 illustrate the present pouch 10 and placement of a curling iron heating appliance A therein. A conventional curling iron A includes a long, narrow heating or curling element C, with a pivoted clip or blade B extending therealong. A blade or clip lever L extends oppositely from the clip or blade B, generally alongside the handle H where it may be manipulated to lift the blade or clip B away from the heating element C in order to place strands or curls of hair therebetween. Finally, an electrical power cord E extends from the handle portion H of the appliance A.

The present pouch 10 is configured to accept the relatively hot heating element C therein, and to insulate it thermally from adjacent materials. The pouch 10 includes a relatively deep appliance receptacle 12 therein, with an open upper or top end 14 into which the heating element portion C of the appliance A may be placed. An appliance retaining strap 16 has a first or attachment end 18 attached to the pouch 10 at the open top end 14 thereof, and extends flexibly across the open top end 14 to attach removably to an attachment point 20 secured oppositely to the retaining strap attachment point. The strap 16 may be formed of or include either hook or loop material of conventional hook and loop fastening material (e.g., Velcro®), with the temporary attachment point 18 comprising the complementary material. The retaining strap 16 is passed between the handle H and lever L of the heated appliance A and the strap distal end 22 temporarily secured to the attachment point 18, to secure the appliance A in the pouch 10. Heated air is vented through the top opening 14, which remains open at all times.

The appliance pouch 10 may include additional features, as well. For example, a hanging loop 24 may be provided at the upper end 14 of the pouch 10, if so desired. The loop 24 has opposed ends 26 and 28 which are secured to the first side 30 of the open upper end 14 of the pouch 10 at the time the appliance retaining strap 16 is installed thereto when the pouch 10 is constructed. The temporary attachment point 20 for the appliance retaining strap 16 is secured adjacent the opposite second side 32 of the open end 14 of the pouch 10, in order for the distal attachment end 22 of the retaining strap 16 to be readily accessible from the front side of the pouch when it is hanging from its loop 24.

In addition, one or more (preferably two) electrical cord retaining straps or ties, respectively 34 and 36, may be provided to secure the appliance electrical cord E externally to the pouch 10. In this manner, the cord E does not come in contact with the heating element C, to preclude damage to the cord E insulation. The two electrical cord retaining ties 34 and 36 each have a first or attachment end, respectively 38 and 40, secured in the lateral seam of the outer or exterior pouch enclosure, as discussed further below. Each tie or strap 34 and 36 may comprise a different type of hook and loop material (e.g., Velcro®), with the two straps 34 and 36 wrapping about and engaging one another to secure the electrical cord E therein, generally as shown in FIG. 2. Other cord retaining means, such as the single strap 16 and temporary attachment point 20 used across the upper opening 14, may be used in lieu of the double retaining ties 34 and 36, if so desired.

FIGS. 3A through 3D illustrate the construction of the present pouch for heated appliances 10. The present pouch 10 is constructed of two congruent layers or plies of flexible material, with the first or interior sheet 42 comprising a highly heat resistant and thermally insulating material. Preferably, the sheet 42 is formed of a woven fabric material for pliability, durability, and ease of construction. A fabric material manufactured by Auburn Manufacturing and known by the trade name Amitherm® has been found to work well in the present appliance pouch 10. Amitherm® is heat resistant to temperatures of 570° Fahrenheit without damage, which provides a large margin of safety as a conventional hair curling iron type appliance A only reaches temperatures of about 280° Fahrenheit.

The second or external ply or sheet of material 44 congruently surrounding the first or innermost layer 42, is not subjected to the relatively high temperatures of the inner or first sheet 42. Thus, the outer sheet 44 need not provide the thermal resistance and insulation of the first or interior sheet 42. Preferably, the second or outer sheet 44 is formed of a pliable and durable material for good wear resistance. A large number of fabric materials are known which provide such properties. Preferably, a material having a suede-like nap or finish is used, in the manner of a randomly patterned corduroy nap. This provides a luxurious feel for the exterior of the pouch 10, while also being reasonably durable.

The first or inner sheet 42 includes a first or inwardly facing surface 46 and an opposite second or outwardly facing surface 50. In a like manner, the second or outer sheet 44 includes a first or inwardly facing surface 48 and an opposite second or outwardly facing surface 52. For the purposes of the present disclosure, the terms "inwardly facing" and "outwardly facing" refer to the orientation of the surfaces in the completed pouch assembly 10. It will be appreciated after a review of the following description, that the two sheets of material 42 and 44 are everted relative to one another and relative to the completed pouch 10 structure from time to time during the construction of the present pouch 10.

Figure 3A:
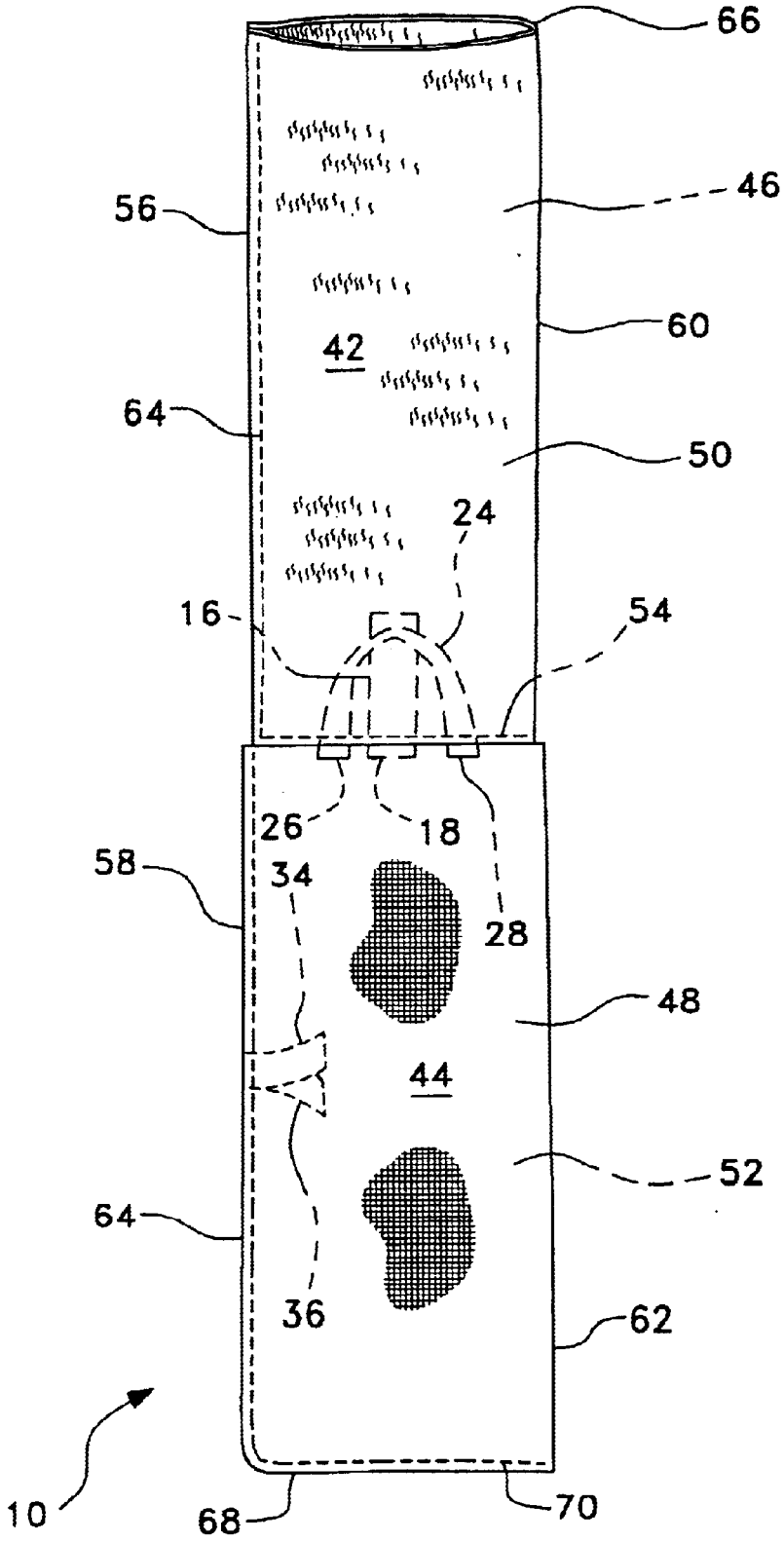
FIG. 3A is a front elevation view illustrating the completion of the initial steps in the construction of the present pouch.

FIG. 3A illustrates the configuration of the partially completed pouch 10, after certain of the initial construction steps have been completed. Construction is begun by placing the first or interior sheet of material 42 atop the second or exterior sheet of material 44, with the two sheets 42 and 44 in registry with one another and with the first or interior surface 46 of the first sheet 42 in contact with the second or exterior surface 52 of the second or outer sheet 44. The two sheets 42 and 44 are then sewn together along their common top end seam 54 (shown in broken lines within the pouch assembly 10 in FIG. 3A, as the assembly has been everted from the construction described to this point).

Installation of the hanging loop 24 and appliance retaining strap 16 is accomplished simultaneously with the step of sewing the two panels 42 and 44 together along their common top end seam 54. Before sewing the seam 54, the loop and strap components 24 and 16 are placed between the two sheets or panels 42 and 44, extending inwardly between the two sheets 42 and 44 and to one side of the centers thereof. The opposed attachment ends 26, 28 of the loop 24 and attachment end 18 of the retaining strap 16 are placed between the common top end 14 of the two sheets 42 and 44, across the line where the seam 54 is to be made. The attachment ends 26, 28 of the loop 24 and the attachment end 18 of the appliance retaining strap 16 are then sewn into the common top end seam 54 at the time the seam 54 is made. The temporary attachment point 20 for the distal end 22 of the appliance retaining strap 16 may also be stitched in place upon the outer surface 52 of the first sheet 44 at this time, as shown in the completed pouch 10 structure in FIGS. 1 and 2.

Once the common top end seam 54 has been completed, the two sheets 42 and 44 are folded longitudinally in half with the first or inner surface 46 of the interior sheet 42 and the second or outer surface 52 of the exterior sheet 44, to the inside of the folded panels. The two sheets 42 and 44 extend oppositely from one another from their common top end seam 54, generally as shown in FIG. 3A. The respective first and second lateral edges 56 for the first or interior sheet 42 and 58 for the exterior sheet 44, are aligned in registry with one another, opposite the folded first edges 60 and 62 of the two sheets 42 and 44.

The two lateral edges 56 of the first or inner sheet 42 and two lateral edges 58 of the second or outer sheet 44 are sewn together at this time, to provide a single, continuous lateral edge seam 64 extending from what will become the bottom or lower end 66 of the first or interior sheet 42, to the bottom or lower end 68 of the opposite second or exterior sheet 44. The bottom end 68 of the second sheet 44 may also be sewn closed at this time by a bottom end seam 70. The lateral edge seam 64 and bottom end seam 70 may be sewn in a single, continuous pass if desired, or formed as two separate operations.

The two electrical cord retaining ties 34 and 36 are also preferably sewn in place during the step of stitching the lateral edge seam 64, in a manner similar to that used for securing the hanging loop 24 and appliance retaining strap 16 in place along the top end seam 54 when that seam was made. The two straps 34 and 36 are inserted inwardly between the two folded sides of the second or exterior sheet 44, before the lateral edge seam 64 is made. The attachment ends 38 and 40 extend across the line where the seam 64 will pass. The lateral edge seam 64 is then sewn, with the seam 64 simultaneously securing the first or attachment ends 38 and 40 of the two straps 34 and 36 in place along the lateral edges 58 of the exterior sheet 44. The two ties 34 and 36 will extend to the outside of the completed structure, when the assembly is everted to complete the pouch 10. Alternatively, a single strap may be provided with a temporary attachment (not shown), similar to the appliance retaining strap 16 and its temporary attachment point 20.

Figure 3B:
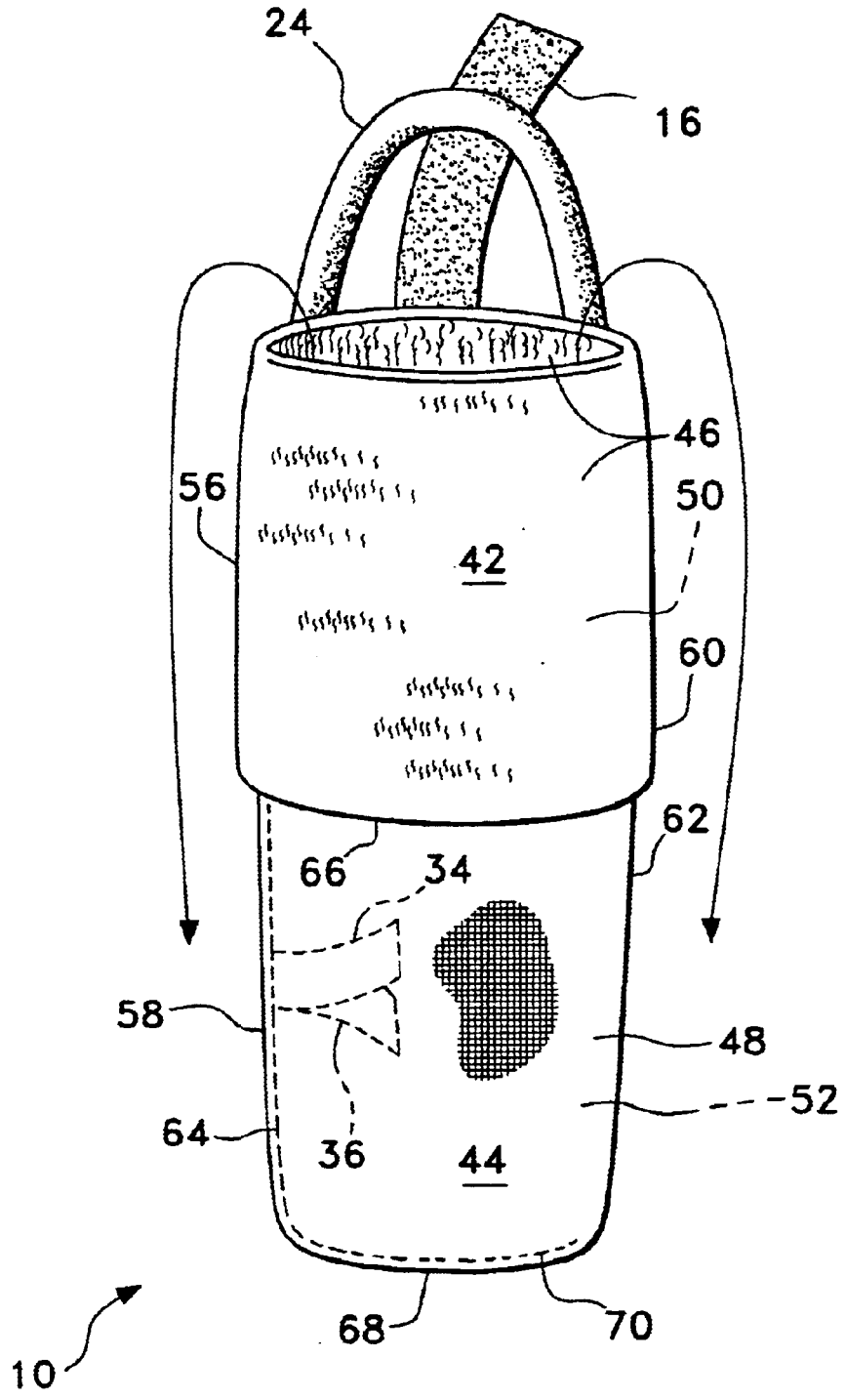
FIG. 3B is a front elevation view illustrating the everting of the outer pocket over the inner pocket, following the procedure illustrated in FIG. 3A.

When the above described steps have been accomplished, the pouch assembly 10 is everted, with the initial eversion process shown in FIG. 3B of the drawings. The still open lower or bottom end 66 of the first or interior sheet 42 is pulled downwardly over the second or exterior sheet 44, with this eversion step shown partially completed in FIG. 3B. It will be noted that the hanging loop 24 and appliance retaining tie 16 will actually be visible only when the first or interior sheet or pocket 42 has been everted to the extent that it nearly covers or conceals the exterior sheet or pocket 44, with the electrical cord ties or straps 34 and 36 remaining concealed within the inside out second or exterior panels or pocket 44 until the eversion has been completed.

Figure 3C:
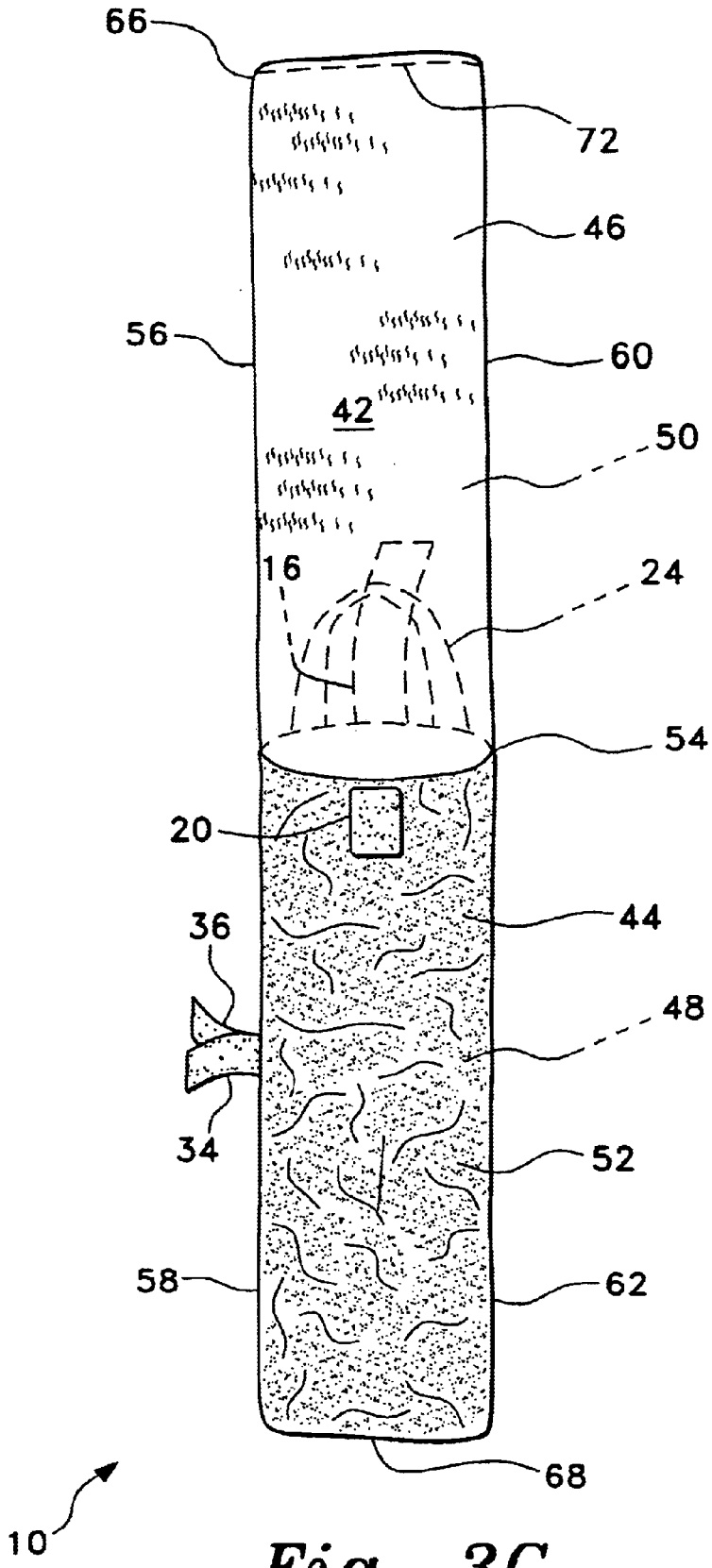
FIG. 3C is a front elevation view illustrating the completion of the everting process of FIG. 3B, and stitching the lower end of the inner pocket closed before inserting it into the outer pocket.

FIG. 3C of the drawings illustrates the completed eversion process begun in FIG. 3B. It will be noted that when the eversion process of FIG. 3B has been completed, that the first or interior pocket 42 will extend below the second or exterior pocket 44, according to the orientation of the process illustrated in FIG. 3B. However, the pouch assembly 10 shown in FIG. 3C has been inverted end to end relative to the assembly of FIG. 3B, after completing the eversion process shown partially accomplished in FIG. 3B. The hanging loop 24 and appliance retaining strap 16 extend to the exterior of the assembly, but are concealed behind the extended first or interior pocket 42 in FIG. 3C. The extended end 66 of the interior pocket 42, which will become the bottom end of the interior pocket 42 upon completion, may be closed by a bottom end closure seam 72 at this time.

Figure 3D:
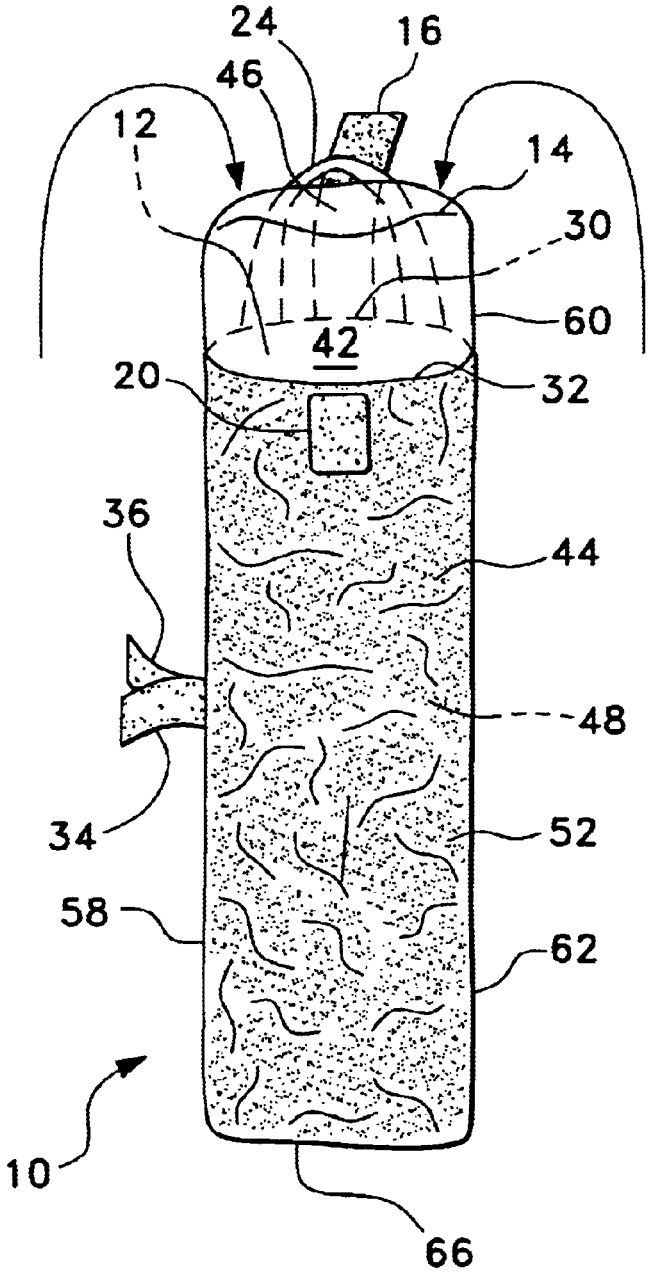
FIG. 3D is a front elevation view illustrating the insertion of the inner pocket into the outer pocket to form the completed double wall or panel pouch of the present invention.

At this point, all that remains to be done to complete the heated appliance pouch 10 of the present invention, is to tuck or evert the first or interior sheet or pocket 42, back into the interior of the second or exterior sheet or pocket 44 to form a two ply pouch 10. FIG. 3D illustrates this process near its completion point, with only a small portion of the interior pocket 42 remaining extended from the exterior pocket 44. It will be seen that the above described construction results in the two pockets or sheets 42 and 44 being joined along only a relatively short common top end seam 54, as shown in FIG. 3A of the drawings. This greatly reduces heat transfer to the outer sheet 44, as no thermally conductive paths exist between the two sheets 42 and 44.

Also, while the two pockets 42 and 44 are very close to the same size, it will be seen that the above described construction results in some slight space or insulating volume 74 (shown as a narrow band of space between the lateral edges 56 of the internal pocket 42 and lateral edges 58 of the external pocket 44, in FIGS. 1 and 2). This results in further protection from heat for any objects or articles which may come in contact with the outer sheet or pocket 44 of the present appliance pouch 10. It will also be seen that the above described construction places all seams, i.e., the common top end seam 54 and common lateral edge seam 64 of the two sheets 42 and 44, and their respective bottom end closure seams 70 and 72, within the insulating volume 74 between the two pockets or sheets 42 and 44. This results in further protection for the threaded seams, and greater durability for the present pouch 10.

In conclusion, the present pouch for heated appliances provides notable advantages over other devices of the related art, in convenience and safety of use and in economy of manufacture. The open top with its appliance retaining strap, electrical cord retainers, and hanging strap all provide significant utility and convenience for the user of the present appliance pouch. The novel construction of the present pouch, with its two plies or layers of fabric joined only along a single common upper edge and separated by an insulating volume or space therebetween, provide superior thermal insulation in comparison to other pouches using two layers of material. While the present pouch for heated appliances is particularly well suited for containing a curling iron, it will be appreciated that a wide variety of different heating appliances may be placed in the present pouch, and/or the pouch may be configured to hold appliances other than a curling iron. The present pouch for heated appliances will prove to be an extremely cost effective means for protecting various articles from the heat generated by a heating appliance, with users of such appliances appreciating the value and features of the present pouch.

It is to be understood that the present invention is not limited to the sole embodiment described above, but encompasses any and all embodiments within the scope of the following claims.

I claim:

1. A pouch for a heated appliance, comprising:

an interior sheet of material defining an appliance receptacle therein;

an exterior sheet of material congruently surrounding said interior sheet of material;

said interior sheet of material and said exterior sheet of material each having an inwardly facing surface, an outwardly facing surface opposite said inwardly facing surface, a folded first edge, a second edge closure seam opposite said folded first edge, a bottom end closure seam, and a top end opposite said bottom end closure seam;

a common top end seam joining each said top end of said interior sheet of material and said exterior sheet of material; and said interior sheet of material and said exterior sheet of material defining an insulating volume therebetween.

2. The pouch for a heated appliance according to claim 1, wherein:

at least said interior sheet of material comprises a highly heat resistant woven fabric material; and at least said exterior sheet of material comprises a durable and wear resistant fabric material.

3. The pouch for a heated appliance according to claim 1, further including:

a permanently open top disposed along said top end of said interior sheet of material and said exterior sheet of material, for accessing said appliance receptacle; and a hanging loop extending from said common top end seam of said interior sheet of material and said exterior sheet of material.

4. The pouch for a heated appliance according to claim 1, further including at least one externally disposed electrical cord retaining tie extending from said second edge closure seam of said exterior sheet of material.

5. The pouch for a heated appliance according to claim 1, further including:

a permanently open top disposed along said top end of said interior sheet of material and said exterior sheet of material, for accessing said appliance receptacle;

said top further having a first edge and a second edge opposite said first edge;

a selectively positionable appliance retaining strap having a permanent attachment point extending from said common top end seam of one said edge of said top, and extending therefrom; and an appliance retaining strap temporary attachment point disposed adjacent one said edge of said top, generally opposite said permanent attachment point of said appliance retaining strap.

6. The pouch for a heated appliance according to claim 1, wherein each said second edge closure seam, each said bottom end closure seam, and said common top end seam of said exterior sheet of material and of said interior sheet of material are disposed within said insulating volume between said interior sheet of material and said exterior sheet of material.

7. A pouch for a heated appliance, comprising:

an interior pocket defining an appliance receptacle therein;

an exterior pocket congruently surrounding said interior pocket;

a permanently open upper opening for accessing said interior pocket;

an appliance retaining strap removably extending across said upper opening;

at least one externally disposed electrical cord retaining tie extending from said exterior pocket; and a hanging loop attached at said upper opening and extending therefrom.

8. The pouch for a heated appliance according to claim 7, wherein:

at least said interior pocket is constructed of a highly heat resistant woven fabric material; and at least said exterior pocket is constructed of a durable and wear resistant fabric material.

9. The pouch for a heated appliance according to claim 7, wherein:

said interior pocket comprises an interior sheet of material;

said exterior pocket comprises an exterior sheet of material;

said interior sheet of material and said exterior sheet of material each have an inwardly facing surface, an outwardly facing surface opposite said inwardly facing surface, a folded first edge, a second edge closure seam opposite said folded first edge, a bottom end closure seam, and a top end opposite said bottom end closure seam;

a common top end seam joins each said top end of said interior sheet of material and said exterior sheet of material; and said interior sheet of material and said exterior sheet of material define an insulating volume therebetween.

10. The pouch for a heated appliance according to claim 9, wherein:

said permanently open upper opening and said common top end seam each have a first edge and a second edge opposite said first edge; and said hanging loop extends from one said edge of said common top end seam of said interior sheet of material and said exterior sheet of material.

11. The pouch for a heated appliance according to claim 9, wherein said at least one externally disposed electrical cord retaining tie extends from said second edge closure seam of said exterior sheet of material.

12. The pouch for a heated appliance according to claim 9, wherein:

said permanently open upper opening and said common top end seam each have a first edge and a second edge opposite said first edge;

said selectively positionable appliance retaining strap has a permanent attachment point extending from said common top end seam of one said edge of said top, and extending therefrom; and an appliance retaining strap temporary attachment point is disposed upon one said edge of said top, generally opposite said permanent attachment point of said appliance retaining strap.

13. The pouch for a heated appliance according to claim 9, wherein each said second edge closure seam, each said bottom end closure seam, and said common top end seam of said exterior sheet of material and of said interior sheet of material are disposed within said insulating volume between said interior sheet of material and said exterior sheet of material.

14. A method for constructing a pouch for a heated appliance, comprising the steps OF:

(a) providing first sheet of material and a second sheet of material, with each sheet of material having an inwardly facing first surface, an outwardly facing second surface opposite the inwardly facing first surface, opposite first and second lateral edges, a bottom end, and a top end opposite the bottom end;

(b) placing the first sheet of material in registry over the second sheet of material, with the inwardly facing first surface of the first sheet of material in contact with the outwardly facing second surface of the second sheet of material;

(b) sewing the top end of each of the two sheets of material together to form a common top end seam;

(c) folding each sheet of material longitudinally in half with the first sheet and second sheet extending oppositely from the common top end seam and with the inwardly facing second surface of the first sheet of material and outwardly facing first surface of the second sheet of material facing inwardly, to place the respective first and second lateral edges of each sheet of material in registry to form a folded first edge along each sheet;

(d) sewing the first and second lateral edges of each sheet of material together to form a single continuous lateral edge seam;

(e) sewing across the bottom end of the second sheet of material to form a bottom end seam therefor;

(f) everting the assembly through the remaining open bottom end of the first sheet of material to position the outwardly facing second surface of the second sheet of material and the inwardly facing first surface of the first sheet of material, facing outwardly;

(g) sewing the bottom end of the first sheet of material, closed; and (h) everting the first sheet of material into the interior of the second sheet of material to form a double ply pouch with an insulating volume between the two sheets of material and with all stitching disposed within the insulating volume, and with the first sheet of material defining a heated appliance receptacle therein.

15. The method for constructing a pouch for a heated appliance according to claim 14, further including the steps of:

(a) providing a hanging loop having opposed ends;

(b) placing the opposed ends of the hanging loop between the top end of each of the two sheets of material with the hanging loop extending inwardly between the two sheets of material, before accomplishing the step of sewing the top end of each of the two sheets of material together; and (c) sewing the opposed ends of the hanging loop between the top end of each of the two sheets of material simultaneously with the step of sewing the top end of each of the two sheets of material together.

16. The method for constructing a pouch for a heated appliance according to claim 14, further including the steps of:

(a) providing an appliance retaining strap having opposed first and second ends;

(b) placing the first end of the appliance retaining strap between the top end of each of the two sheets of material with the strap extending inwardly between the two sheets of material, before accomplishing the step of sewing the top end of each of the two sheets of material together;

(c) sewing the first end of the appliance retaining strap between the top end of each of the two sheets of material simultaneously with the step of sewing the top end of each of the two sheets of material together; and (d) sewing an appliance retaining strap temporary attachment point to the outwardly facing second surface of the second sheet of material, adjacent the top end of the two sheets of material and opposite the captured first end of the appliance retaining strap.

17. The method for constructing a pouch for a heated appliance according to claim 14, further including the steps of:

(a) providing at least one electrical cord retaining tie having opposed first and second ends;

(b) placing the first end of the at least one electrical cord retaining tie between the first and second lateral edges of the second sheet of material with the at least one electrical cord retaining tie extending inwardly between the two first and second lateral edges of the second sheet of material, before accomplishing the step of sewing the first and second lateral edges of each sheet of material together to form a single continuous lateral edge seam; and (c) sewing the first end of the at least one electrical cord retaining tie between the two first and second lateral edges of the second sheet of material simultaneously with the step of sewing the first and second lateral edges of each sheet of material together to form a single continuous lateral edge seam.

18. The method for constructing a pouch for a heated appliance according to claim 17, further including the steps of:

(a) providing a first electrical cord retaining tie having opposed first and second ends and a first attachment material disposed thereon;

(b) providing a second electrical cord retaining tie having opposed first and second ends and a second attachment material disposed thereon, with the second attachment material being removably attachable to the first attachment material of the first electrical cord retaining tie;

(b) placing each first end of the first and second electrical cord retaining ties between the first and second lateral edges of the second sheet of material with the first and second electrical cord retaining ties extending inwardly between the two first and second lateral edges of the second sheet of material, before accomplishing the step of sewing the first and second lateral edges of each sheet of material together to form a single continuous lateral edge seam; and (c) sewing the first end of the first and second electrical cord retaining ties between the two first and second lateral edges of the second sheet of material simultaneously with the step of sewing the first and second lateral edges of each sheet of material together to form a single continuous lateral edge seam.

* * * * *